US009859620B1

(12) United States Patent
Gauba et al.

(10) Patent No.: US 9,859,620 B1
(45) Date of Patent: Jan. 2, 2018

(54) INCREASING ENERGY EFFICIENCY OF A SMALL CELL ANTENNA

(71) Applicant: Sprint Communications Company L.P., Overland Park, KS (US)

(72) Inventors: Maneesh Gauba, Overland Park, KS (US); Eugene S. Mitchell, Jr., Blue Springs, MO (US); Stephen R. Bales, Lee's Summit, MO (US)

(73) Assignee: Sprint Communications Company L.P., Overland Park, KS (US)

( * ) Notice: Subject to any disclaimer, the term of this patent is extended or adjusted under 35 U.S.C. 154(b) by 326 days.

(21) Appl. No.: 14/620,056

(22) Filed: Feb. 11, 2015

(51) Int. Cl.
*H01Q 21/20* (2006.01)
*H01Q 19/10* (2006.01)
*H01Q 3/20* (2006.01)

(52) U.S. Cl.
CPC ..... *H01Q 19/108* (2013.01); *H01Q 3/20* (2013.01); *H01Q 21/205* (2013.01)

(58) Field of Classification Search
CPC ..... H01Q 19/108; H01Q 3/20; H01Q 21/205
USPC ..... 343/800
See application file for complete search history.

(56) References Cited

U.S. PATENT DOCUMENTS 6,140,972 A * 10/2000 Johnston ..... H01Q 19/106 343/725
6,173,191 B1 * 1/2001 Jennings, III ..... H01Q 1/246 455/277.1

* cited by examiner

*Primary Examiner* — Khai M Nguyen

(57) ABSTRACT

Increased energy efficiency of a small cell antenna is provided. Electromagnetic energy radiated outside the desired radiation pattern of a small cell antenna is wasted. An antenna is provided which includes a circular set of antenna elements having a plurality of radio-frequency (RF) reflectors positioned within and around the circumference of the set of antenna elements facing substantially outward. Each RF reflector is configured to reflect the RF signal transmitted from the ring outwardly from a corresponding antenna element at an angle with respect to the plane of the circular set of antenna elements. By adjusting the angles of the reflectors, the signal may be reflected downward toward target areas that are nearer or farther from the small cell.

18 Claims, 7 Drawing Sheets

INCREASING ENERGY EFFICIENCY OF A SMALL CELL ANTENNA

SUMMARY

A high-level overview of various aspects of the invention is provided here for that reason, to provide an overview of the disclosure and to introduce a selection of concepts that are further described in the detailed-description section below. This summary is not intended to identify key features or essential features of the claimed subject matter, nor is it intended to be used as an aid in isolation to determine the scope of the claimed subject matter. In brief and at a high level, this disclosure describes, among other things, ways to provide increased energy efficiency of a small cell. Electromagnetic energy radiated outside the desired radiation pattern of a small cell antenna is wasted. An antenna is provided which includes a circular antenna element having a plurality of radio-frequency (RF) reflectors positioned within and around the circumference of the antenna element facing substantially outward. Each RF reflector is configured to reflect the RF signal transmitted from the ring outwardly from the antenna at an angle with respect to the plane of the ring. By adjusting the angles of the reflectors, the signal may be reflected downward toward target areas that are nearer or farther from the small cell.

BRIEF DESCRIPTION OF THE SEVERAL VIEWS OF THE DRAWINGS

Illustrative embodiments of the present invention are described in detail below with reference to the attached drawing figures, and wherein.

DETAILED DESCRIPTION

Figure 1:
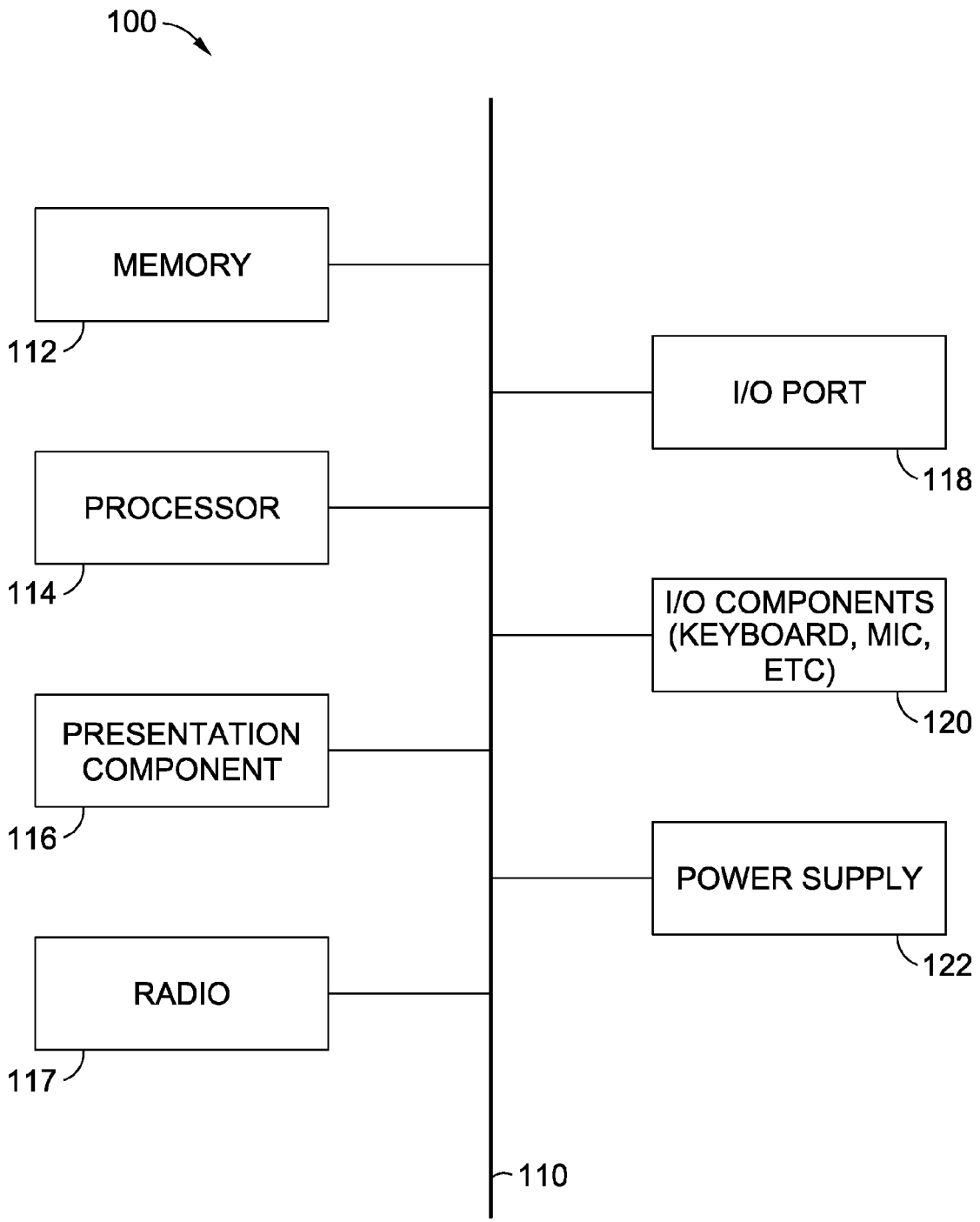
FIG. 1 depicts a block diagram of an illustrative mobile computing device suitable for use with an embodiment of the present invention.

The subject matter of select embodiments of the present invention is described with specificity herein to meet statutory requirements. But the description itself is not intended to define what we regard as our invention, which is what the claims do. The claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

Throughout this disclosure, several acronyms and shorthand notations are used to aid the understanding of certain concepts pertaining to the associated system and services. These acronyms and shorthand notations are intended to help provide an easy methodology of communicating the ideas expressed herein and are not meant to limit the scope of the present invention. The following is a list of some of these acronyms:

CDMA Code Division Multiple Access
GIS Geographic Information System
GPRS General Packet Radio Service
GSM Global System for Mobile Communications
LTE Long Term Evolution
RF Radio Frequency
TDMA Time Division Multiple Access Further, various technical terms are used throughout this description. An illustrative resource that fleshes out various aspects of these terms can be found in Newton's Telecom Dictionary, 27th Edition (2013).

Embodiments of the present invention may be embodied as, among other things: a method, system, or set of instructions embodied on one or more computer-readable media. The term "computer-readable media" as used herein does not include signals per se. Computer-readable media include both volatile and nonvolatile media, removable and nonremovable media, and contemplate media readable by a database, a switch, and various other network devices. By way of example, and not limitation, computer-readable media include media implemented in methods and/or technologies for storing information readable by a computing device. Examples of stored information include program modules including instructions, data structures, other data representations, and the like. Media examples include, but are not limited to information-delivery media, RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store data momentarily, temporarily, or permanently.

One issue with mobile networks is that of gaps in coverage. Gaps may exist for a number of reasons. For example, coverage may be spotty in cities due to obstructions, such as structures, or a lack of available (or desirable) locations to erect traditional cellular towers. Another issue with mobile networks is that of users' increasing demands for mobile data, pushing or exceeding the available bandwidth. Small cells, which are less obtrusive and have a more limited range than macro cells (e.g., traditional cellular towers/base stations), are increasingly being utilized to address these and other issues. As used herein, the term "small cell" includes femtocells, picocells, and microcells, which are known to one of ordinary skill in the art, and also generally includes radio access nodes used in a manner similar. Some embodiments of the invention are utilized with cellular-type technologies. However, other embodiments of the invention are not limited to cellular technology, but may be utilized with other radio access technologies either related or unrelated to traditional mobile networks.

Small cells have a much smaller footprint than a traditional cellular site, covering a smaller area, and utilize smaller, lower-power antennas. Thus, rather than requiring a large, obtrusive tower, a small cell may be mounted on existing structures, such as buildings, utility poles, light poles, and so forth. For example, a small cell may be mounted on a light pole in a parking lot adjacent to one or more businesses to provide cellular access specifically to those businesses, and/or to pedestrians in and around the parking lot (or other open area). Accordingly, network access may thus be provided specifically to an area that is otherwise blocked or shielded from traditional cellular towers. Additionally, the use of small cells enables greater reuse of available frequencies, thus increasing overall capacity. Traditional cellular networks reuse frequencies in cells that are spaced far enough apart to avoid interference. However, the substantially reduced size of small cells enables much greater frequency reuse, because the small cells do not need to be as widely spaced to avoid interference.

Antennas radiate electromagnetic energy, i.e., a signal, in specific radiation patterns. For example, an antenna may be designed or configured with a radiation pattern directing radiation in a particular direction, in all directions, in all horizontal directions, and so forth. Ideally, an antenna would radiate only in the desired direction(s) or with the desired radiation pattern. However, real-world antennas only approximate a desired radiation pattern. Electromagnetic energy radiated outside of the desired radiation pattern is thus wasted.

One type of antenna that may be utilized in a small cell is an omnidirectional antenna, which is configured to radiate substantially in all directions on one plane, for example, along a horizontal plane. However, while most of the energy radiates substantially along the plane, a portion of the energy radiates above the plane and a portion radiates below the plane. The portion of electromagnetic energy that radiates above the plane may be wasted energy in the context of a small cell, which may radiate substantially horizontally at some height from a structure or a pole, as described above. It may be that only the portions of the energy radiating horizontally and downward are actually usable by the intended targets, whether nearby businesses, homes, pedestrians, and so forth. Additionally, an omnidirectional antenna may be placed at a substantial height, e.g., 30 to 50 feet or more above the ground, potentially higher than the intended targets. The horizontally-radiated energy may then be wasted in addition to the upwardly-radiated energy.

In an embodiment, a reflector is utilized to reflect electromagnetic energy from an antenna downward and/or toward a target or target area, such that electromagnetic energy that would otherwise be wasted (e.g., radiated upward) is utilized, thus improving the energy efficiency of the antenna. In an embodiment, the antenna is a small-cell antenna. In some embodiments, the antenna is an omnidirectional antenna, or may be a modified omnidirectional antenna, or may comprise omnidirectional antenna elements. The reflector may be a single reflector, or may include a plurality of reflectors and/or reflector segments. The reflector may be constructed of any of a number of different materials, such that the material used adequately reflects the radio-frequency (RF) electromagnetic radiation. The type of material may depend upon the specific frequency or frequencies radiated from an antenna. As used herein, the term "radio frequency" refers to the frequencies of radio waves and/or alternating currents that carry radio signals. "Radio frequency" as used herein does not refer to, nor is it limited to, a specific frequency range, but includes frequencies within the range of 3 kHz to 300 GHz.

In a first aspect, an antenna is provided which includes a circular antenna element, i.e., configured as a ring. A plurality of RF reflectors is positioned within and around the circumference of the ring facing substantially outward. Each RF reflector is configured to reflect an RF signal transmitted from the ring outwardly from the antenna at an angle with respect to the plane of the ring.

In a second aspect, an antenna is provided which includes a plurality of circular antenna elements. Each antenna element is configured as a ring and oriented substantially horizontally. The antenna elements are positioned vertically with respect to each other. The antenna also includes a plurality of RF reflectors, with each RF reflector positioned within a respective one of the antenna elements. Each RF reflector is configured to reflect an RF signal transmitted from its respective antenna element substantially outwardly from the antenna at an angle with respect to horizontal.

In a third aspect, an RF reflector is provided, which includes a plurality of RF reflector segments positioned end-to-end in an approximation of a closed shape. Each RF reflector segment is configured to reflect outwardly from the closed shape, at an angle with respect to the plane of the closed shape, a signal generated proximate to the RF reflector segment.

Turning now to FIG. 1, a block diagram of an illustrative mobile computing device ("mobile device") is provided and referenced generally by the numeral 100. Although some components are shown in the singular, they may be plural. For example, mobile device 100 might include multiple processors or multiple radios, etc. As illustratively shown, mobile device 100 includes a bus 110 that directly or indirectly couples various components together including memory 112, a processor 114, a presentation component 116, a radio 117, input/output ports 118, input/output components 120, and a power supply 122.

Memory 112 might take the form of one or more of the aforementioned media. Thus, we will not elaborate more here, only to say that memory component 112 can include any type of medium that is capable of storing information in a manner readable by a computing device. Processor 114 might actually be multiple processors that receive instructions and process them accordingly. Presentation component 116 includes the likes of a display, a speaker, as well as other components that can present information (such as a lamp (LED), or even lighted keyboards).

Radio 117 represents a radio that facilitates communication with a wireless telecommunications network. Illustrative wireless telecommunications technologies include LTE, CDMA, GPRS, TDMA, GSM, and the like. In some embodiments, radio 117 might also facilitate other types of wireless communications including Wi-Fi communications and GIS communications.

Input/output port 118 might take on a variety of forms. Illustrative input/output ports include a USB jack, stereo jack, infrared port, proprietary communications ports, and the like. Input/output components 120 include items such as keyboards, microphones, touch screens, and any other item usable to directly or indirectly input data into mobile device 110. Power supply 122 includes items such as batteries, fuel cells, or any other component that can act as a power source to power mobile device 110.

Figure 2:
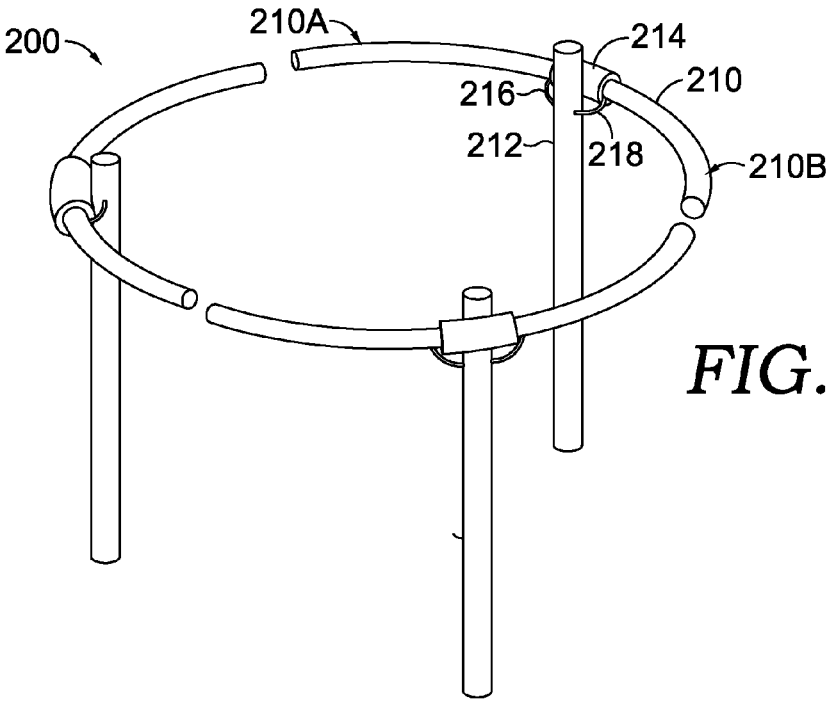
FIG. 2 depicts an antenna suitable for use with an embodiment of the invention.

With reference to FIG. 2, an antenna suitable for use with an embodiment of the invention is depicted, and is generally referred to as antenna 200. Antenna 200 is but one example of a suitable antenna, and is not intended to suggest any limitation as to the scope of use or functionality of embodiments of the invention. Neither should antenna 200 be interpreted as having any dependency or requirement relating to any single component or combination of components illustrated therein. Antenna 200 includes an antenna element 210 that is supported by a support post 212. In an embodiment, antenna element 210 is supported by more than one support post 212. In another embodiment, support post 212 may take the form of a bracket or other mechanical fixture. In an embodiment, antenna element 210 is a dipole antenna element having a pole 210A and a pole 210B. Antenna element 210 may be affixed to support post 212 by a fixture 214. Fixture 214 may include a collar, a bracket, an adhesive, and/or other types of mechanical connections. Antenna element 210 is electrically connected to a feeder (not shown) that includes a conductor 216, which is electrically connected to pole 210A, and a conductor 218, which is electrically connected to pole 210B. In an embodiment, the feeder passes within support post 212, and conductors 216 and 218 emerge from support post 212. In some embodiments, the feeder lies outside of support post 212. In some embodiments, the feeder passes within support post 212, and conductors 216 and 218 connect to antenna element 210 internally without emerging from support post 212.

In an embodiment, antenna 200 includes three dipole antenna elements 210 which are curved and positioned in a circular ring-shaped configuration. In an embodiment, the configuration of antenna elements 210 is not limited to a circular ring configuration, but may include other shapes as well. For example, in an embodiment antenna elements 210 may be straight rather than curved, and may be configured as a polygonal shape, such as a triangle. In an embodiment, antenna 200 may include fewer or greater than three antenna elements 210.

Antenna 200 may include additional components which are not shown in FIG. 2. For example, antenna 200 may include a base plate, to which support post 212 is affixed, and a housing atop the base plate surrounding antenna element 210. These additional components are omitted from FIG. 2 for clarity of the figure.

Figure 3:
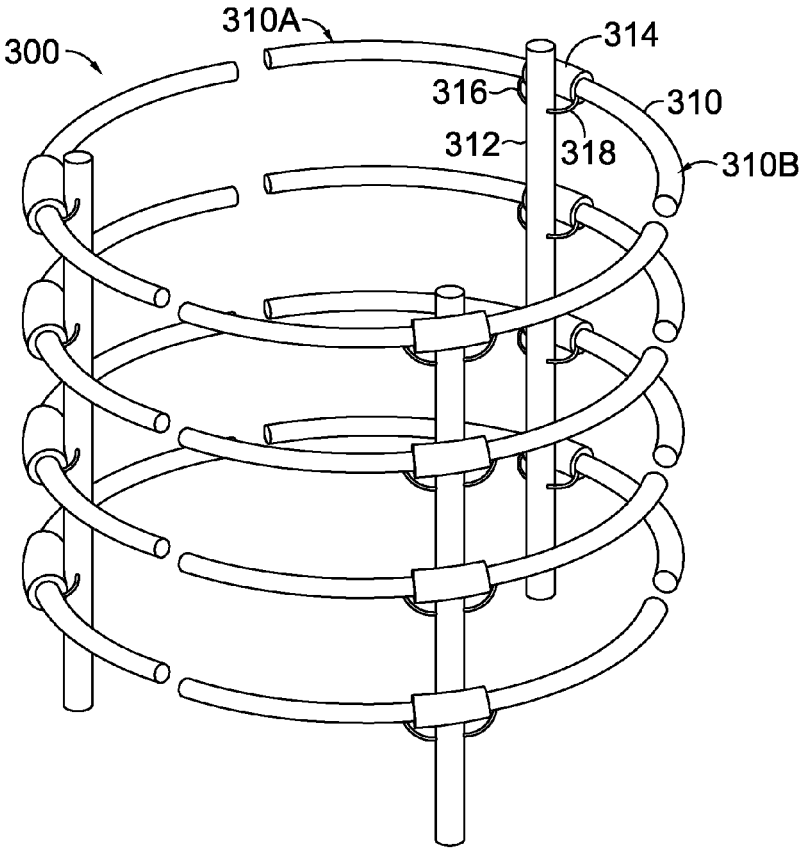
FIG. 3 depicts an antenna suitable for use with an embodiment of the invention.

With reference to FIG. 3, an antenna suitable for use with an embodiment of the invention is depicted, and is generally referred to as antenna 300. Antenna 300 is but one example of a suitable antenna, and is not intended to suggest any limitation as to the scope of use or functionality of embodiments of the invention. Neither should antenna 300 be interpreted as having any dependency or requirement relating to any single component or combination of components illustrated therein. Antenna 300 includes an antenna element 310 that may be similar to antenna element 210 described above with regard to FIG. 2. Antenna element 310 may be supported by one or more support posts 312, in a manner similar to antenna element 210 and support post 212 described above. In an embodiment, antenna element 310 is a dipole antenna element having a pole 310A and a pole 310B. Antenna element 310 may be affixed to support post 312 by a fixture 314. Fixture 314 may include a collar, a bracket, an adhesive, and/or other types of mechanical connections. Antenna element 310 is electrically connected to a feeder (not shown) that includes a conductor 316, which is electrically connected to pole 310A, and a conductor 318, which is electrically connected to pole 310B. In an embodiment, the feeder passes within support post 312, and conductors 316 and 318 emerge from support post 312. In some embodiments, the feeder lies outside of support post 312. In some embodiments, the feeder passes within support post 312, and conductors 316 and 318 connect to antenna element 310 internally without emerging from support post 312.

In an embodiment, antenna 300 includes three dipole antenna elements 310 which are curved and positioned in a circular ring-shaped configuration. In an embodiment, the configuration of antenna elements 310 is not limited to a circular ring configuration, but may include other shapes as well. For example, in an embodiment antenna elements 310 may be straight rather than curved, and may be configured as a polygonal shape, such as a triangle. In an embodiment, antenna 300 may include fewer or greater than three antenna elements 310.

In an embodiment, antenna 300 includes one or more sets of three dipole antenna elements 310 which are curved and positioned in one or more circular ring-shaped configurations. FIG. 3 depicts four sets of antenna elements, each set including three antenna elements 310, each set configured as a circular ring, and each set parallel to, and spaced apart from, the other sets. In an embodiment, each set of antenna elements 310 is parallel to the other sets and positioned axially along a centerline perpendicular to the plane of each set of antenna elements 310 and passing through the center of each set. Thus, when the sets of antenna elements 310 are oriented horizontally, each set of antenna elements 310 is positioned vertically with respect to the other sets, as depicted in FIG. 3. In an embodiment, antenna 300 may include greater or fewer than four sets of antenna elements 310. As described above, the configuration of each set of antenna elements 310 may include shapes other than a circular ring. In an embodiment, each set of antenna elements 310 may include fewer or greater than three antenna elements 310. Antenna 300 may include additional components which are not shown in FIG. 3. For example, antenna 300 may include one or more feed lines, described above, such as a cable or other type of transmission line, which carries RF current from a transmitter to antenna elements 310. In an embodiment, two or more antenna elements 310 are connected to the same feed line. In some embodiments, all of the antenna elements 310 are connected to the same feed line, and are thus collectively driven by a single antenna feed. As another example, antenna 300 may include a base plate, to which support posts 312 are affixed, and a housing atop the base plate surrounding antenna element 310. These additional components are omitted from FIG. 3 for clarity of the figure.

Figure 4:
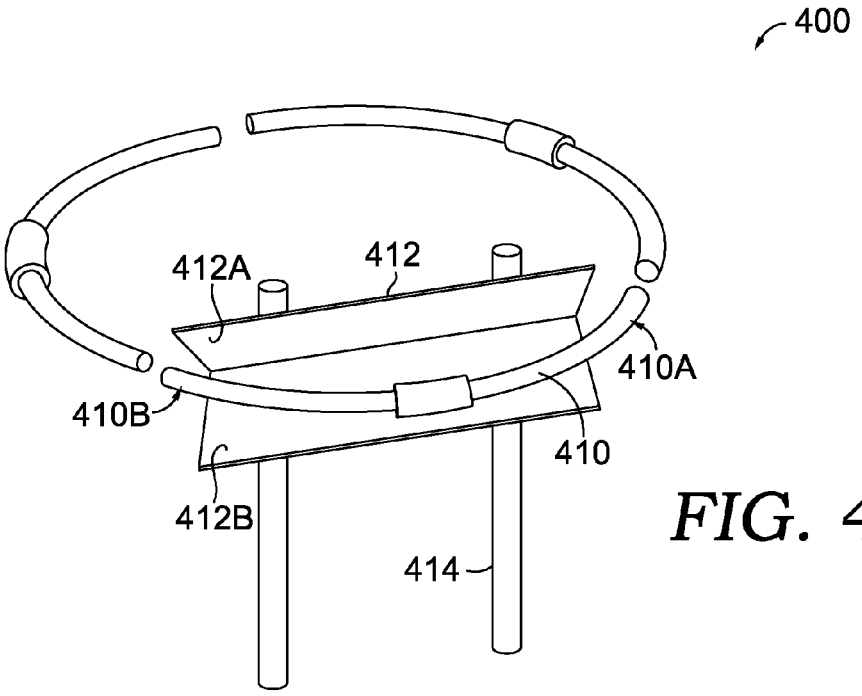
FIG. 4 depicts an antenna suitable for use with an embodiment of the invention.

With reference to FIG. 4, an antenna suitable for use with an embodiment of the invention is depicted, and is generally referred to as antenna 400. Antenna 400 is but one example of a suitable antenna, and is not intended to suggest any limitation as to the scope of use or functionality of embodiments of the invention. Neither should antenna 400 be interpreted as having any dependency or requirement relating to any single component or combination of components illustrated therein. FIG. 4 is described below with reference also to FIG. 10. Antenna 400 includes an antenna element 410 that may be similar to antenna element 210 described above with regard to FIG. 2. Antenna element 410 may be supported by one or more supports (not shown), in a manner similar to antenna element 210 described above with regard to FIG. 2. In an embodiment, antenna element 410 is a dipole antenna element having a pole 410A and a pole 410B. In an embodiment, antenna 400 includes a set of three dipole antenna elements 410 which are curved and positioned in a circular ring-shaped configuration. In an embodiment, the configuration of antenna elements 410 is not limited to a circular ring configuration, but may include other shapes as well, similar to antenna elements 210 described above.

Antenna 400 also includes an RF reflector 412 that is positioned proximate to a portion of antenna element 410, such that the reflective surface of RF reflector 412 reflects electromagnetic energy generated by antenna element 410 outward from antenna element 410 along, or at an angle to, the plane of the set of antenna elements 410. In an embodiment, RF reflector 412 is electrically isolated from ground.

RF reflector 412 may be a single reflector, or may be a reflector assembly that includes a plurality of reflectors and/or reflector segments. RF reflector 412 may be constructed of any of a number of different materials, such that the material used adequately reflects the RF electromagnetic radiation generated by antenna element 410. The type of material may depend upon the specific frequency or frequencies radiated from an antenna. In an embodiment, RF reflector 412 is supported by one or more support posts 414. FIG. 4 depicts two support posts 414; however, some embodiments may include fewer or greater than two support posts 414.

In an embodiment, the angle of RF reflector 412 is adjustable upward and/or downward, such that adjusting the angle of RF reflector 412 changes the angle of a reflected signal with respect to the plane of antenna elements 410. Thus, in an embodiment, by adjusting the angle of RF reflector 412, the signal may be reflected, or deflected, at an angle toward a target area nearer or further from the antenna. Accordingly, in an embodiment RF reflector 412 is configured with one or more pivot points (not shown) at or near the junction of RF reflector 412 and support posts 414. Alternatively, RF reflector 412 may be joined to support posts 414 by one or more members incorporating pivot points and/or having pivot points located at one or both ends of the joining members. A pivot point may include a bendable material, a hinge, a pin, and/or a shaft about which a connected part turns or rotates. A rotated/adjusted position or angle of the pivot point and/or connected part may be fixed at a given position by friction, a locking mechanism, or other mechanical action. A pivot point is not limited to a hinge, a pin, and/or a shaft. The angle of RF reflector 412 may be adjusted manually at the time of installation, during a scheduled maintenance procedure, or at other times. In an embodiment, reflector 412 includes an upper reflector portion 412A and a lower reflector portion 412B. In an embodiment, the angles of upper reflector portion 412A and lower reflector portion 412B are independently adjustable, such that the angle of a reflected signal is independently adjustable for each of upper reflector portion 412A and lower reflector portion 412B.

Antenna 400 may include additional components which are not shown in FIG. 4. For example, antenna 400 may include one or more feed lines, such as a cable or other type of transmission line, which connects a transmitter and/or receiver to antenna element 410. As another example, antenna 400 may include a base plate, to which support posts 414 are affixed, and a housing atop the base plate surrounding antenna element 410. These additional components are omitted from FIG. 4 for clarity of the figure.

Figure 5:
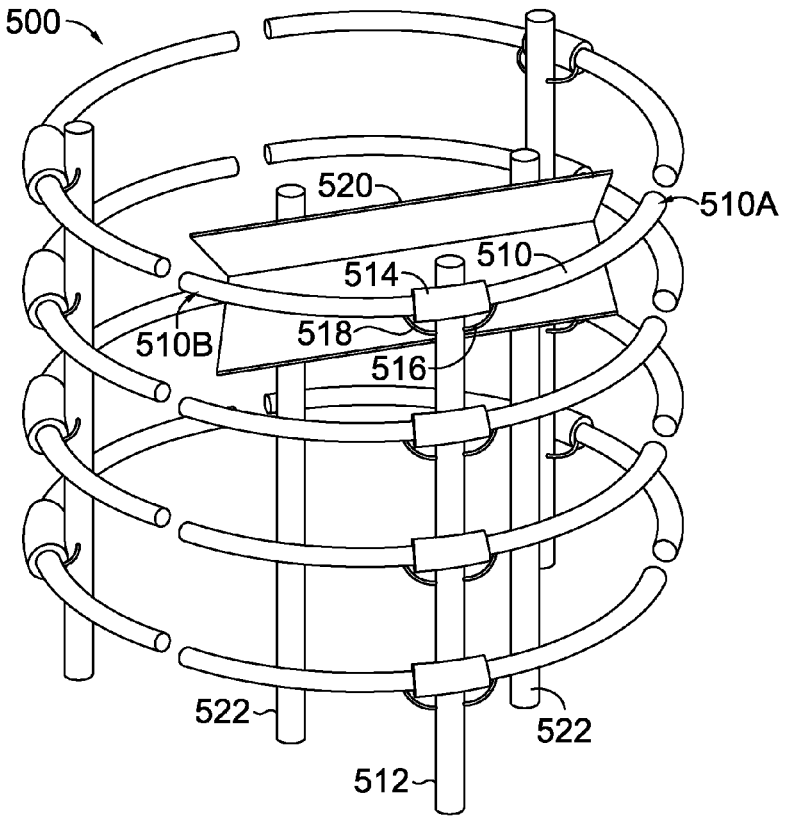
FIG. 5 depicts an antenna suitable for use with an embodiment of the invention.

With reference to FIG. 5, an antenna suitable for use with an embodiment of the invention is depicted, and is generally referred to as antenna 500. Antenna 500 is but one example of a suitable antenna, and is not intended to suggest any limitation as to the scope of use or functionality of embodiments of the invention. Neither should antenna 500 be interpreted as having any dependency or requirement relating to any single component or combination of components illustrated therein. Antenna 500 includes an antenna element 510 that may be similar to antenna element 210 described above with regard to FIG. 2. Antenna element 510 may be supported by one or more support posts 512, in a manner similar to antenna element 210 and support post 212 described above. In an embodiment, antenna element 510 is a dipole antenna element having a pole 510A and a pole 5106. Antenna element 510 may be affixed to support post 512 by a fixture 514. Fixture 514 may include a collar, a bracket, an adhesive, a weld, and/or other types of mechanical connections. Antenna element 510 is electrically connected to a feeder (not shown) that includes a conductor 516, which is electrically connected to pole 510A, and a conductor 518, which is electrically connected to pole 5106. In an embodiment, the feeder passes within support post 512, and conductors 516 and 518 emerge from support post 512. In some embodiments, the feeder lies outside of support post 512. In some embodiments, the feeder passes within support post 512, and conductors 516 and 518 connect to antenna element 510 internally without emerging from support post 512.

In an embodiment, antenna 500 includes three dipole antenna elements 510 which are curved and positioned in a circular ring-shaped configuration. In an embodiment, the configuration of antenna elements 510 is not limited to a circular ring configuration, but may include other shapes as well. For example, in an embodiment antenna elements 510 may be straight rather than curved, and may be configured as a polygonal shape, such as a triangle. In an embodiment, antenna 500 may include fewer or greater than three antenna elements 510.

In an embodiment, antenna 500 includes one or more sets of three dipole antenna elements 510 which are curved and positioned in one or more circular ring-shaped configurations. FIG. 5 depicts four sets of antenna elements, each set including three antenna elements 510, each set configured as a circular ring, and each set parallel to, and spaced apart from, the other sets. In an embodiment, each set of antenna elements 510 is parallel to the other sets and is positioned axially along a centerline perpendicular to the planes of each set of antenna elements 510. In one embodiment, antenna elements 510 are oriented horizontally, and are positioned vertically with respect to each other. In an embodiment, antenna 500 may include greater or fewer than four sets of antenna elements 510. As described above, the configuration of each set of antenna elements 510 may include shapes other than a circular ring. In an embodiment, each set of antenna elements 510 may include fewer or greater than three antenna elements 510.

Antenna 510 also includes an RF reflector 520 that is positioned proximate to a portion of one or more of antenna elements 510, such that the reflective surface of RF reflector 520 reflects electromagnetic energy generated by the proximate portion of antenna element 510 outward from the set of antenna elements 510 along, or at an angle to, the plane of the set of antenna elements 510. In an embodiment, RF reflector 520 is electrically isolated from ground. RF reflector 520 may be similar to RF reflector 412 described above. RF reflector 520 may be a single reflector, or may include a plurality of reflectors and/or reflector segments placed within and/or around antenna element 510. In an embodiment, RF reflector 520 is part of an RF reflector assembly that includes a plurality of RF reflectors 520. FIG. 5 depicts a reflector 520 proximate to only one antenna element 510; however, in some embodiments, one or more reflectors and/or reflector segments are placed in a similar fashion proximate to any or all of the antenna elements 510. In an embodiment, antenna 500 includes four sets of antenna elements 510, with three RF reflectors 520 positioned within and end-to-end around the circumference or perimeter of each set of antenna element 510 (similar to RF reflectors 620 depicted in FIG. 6, and/or RF reflectors 720 depicted in FIG. 7, described below), for a total of twelve RF reflectors 520. In an embodiment, RF reflectors 520 form a closed shape, or an approximation of a closed shape, proximate to each set of antenna elements 510, such that the plurality of closed shapes are oriented parallel to each other and positioned axially along a centerline perpendicular to the planes of the closed shapes and passing through the center of each closed shape. A closed shape formed by RF reflectors 520 may be an approximation of a closed shape in that the RF reflectors 520 are not physically (or electrically) joined at the ends. Thus, there may be gaps between the RF reflectors 520 at the vertices of the closed shape. Each group (i.e., each closed shape) of RF reflector segments 520 is configured to be positioned within and around the circumference or perimeter of a respective set of antenna elements 510. In one embodiment, the closed shapes formed by RF reflectors 520 are oriented substantially horizontally, and are positioned vertically with respect to each other, in similar fashion to antenna elements 510 described above. RF reflector 520 may be constructed of any of a number of different materials, such that the material used adequately reflects the RF electromagnetic radiation generated by the proximate portion of antenna element 510. The type of material may depend upon the specific frequency or frequencies radiated from antenna element 510. In an embodiment, RF reflector 520 is supported by one or more support posts 522. FIG. 5 depicts two support posts 522; however, some embodiments may include fewer or greater than two support posts 522. Antenna 500 may include additional components which are not shown in FIG. 5. For example, antenna 500 may include one or more feed lines, such as a cable or other type of transmission line, which carries RF current from a transmitter to antenna elements 510. In an embodiment, two or more antenna elements 510 are connected to the same feed line. In some embodiments, all of the antenna elements 510 are connected to the same feed line, and are thus collectively driven by a single antenna feed. As another example, antenna 500 may include a base plate, to which support posts 512 and 522 are affixed, and a housing atop the base plate surrounding antenna elements 510. These additional components are omitted from FIG. 5 for clarity of the figure.

Figure 6:
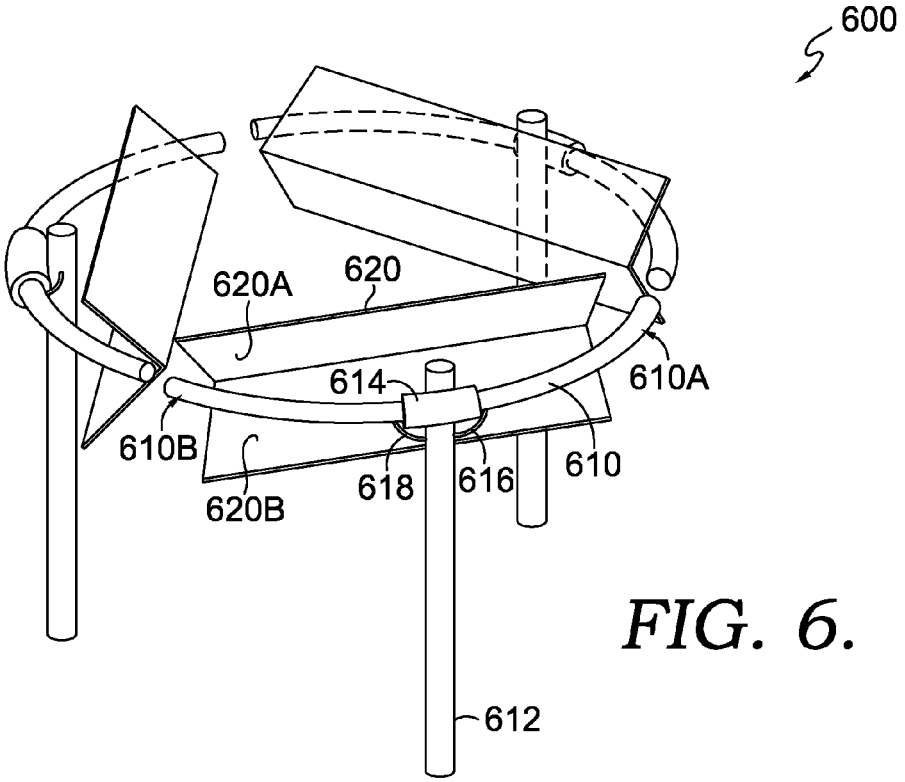
FIG. 6 depicts an antenna suitable for use with an embodiment of the invention.

With reference to FIG. 6, an antenna suitable for use with an embodiment of the invention is depicted, and is generally referred to as antenna 600. Antenna 600 is but one example of a suitable antenna, and is not intended to suggest any limitation as to the scope of use or functionality of embodiments of the invention. Neither should antenna 600 be interpreted as having any dependency or requirement relating to any single component or combination of components illustrated therein. Antenna 600 includes an antenna element 610 that may be similar to antenna element 210 described above with regard to FIG. 2. Antenna element 610 may be supported by one or more support posts 612, in a manner similar to antenna element 210 and support post 212 described above. In an embodiment, antenna element 610 is a dipole antenna element having a pole 610A and a pole 610B. Antenna element 610 may be affixed to support post 612 by a fixture 614, which may be similar to fixture 214 described above. Antenna element 610 is electrically connected to a feeder (not shown) by conductors 616 and 618, which are electrically connected to poles 610A and 610B, respectively, in a manner similar to that described above with regard to FIG. 2.

In an embodiment, antenna 600 includes a set of three dipole antenna elements 610 which are curved and positioned in a circular ring-shaped configuration. In an embodiment, the configuration of antenna elements 610 is not limited to a circular ring configuration, but may include other shapes as well. For example, in an embodiment antenna elements 610 may be straight rather than curved, and may be configured as a polygonal shape, such as a triangle. In an embodiment, antenna 600 may include fewer or greater than three antenna elements 510.

Antenna 600 also includes one or more RF reflectors 620 that are positioned proximate to respective portions of antenna elements 610, such that the reflective surface of RF reflector 620 reflects electromagnetic energy generated by antenna element 610 outward from antenna elements 610 along, or at an angle to, the plane of the set of antenna elements 610. In an embodiment, RF reflectors 620 are positioned within and around the circumference of the ring or other shape of the set of antenna elements 610. In an embodiment, RF reflectors 620 are positioned end-to-end in an approximation of a closed shape, in a manner similar to RF reflectors 520 described above. One example of a closed shape is a triangle, corresponding to the closed shaped formed by RF reflectors 620 as depicted in FIG. 6. Although FIG. 6 depicts three RF reflectors 620, in some embodiments antenna 600 includes fewer or more than three RF reflectors 620. In one embodiment, RF reflectors 620 are segments of a single RF reflector. RF reflector 620 may be constructed of any of a number of different materials, such that the material used adequately reflects the RF electromagnetic radiation generated by antenna element 610. The type of material may depend upon the specific frequency or frequencies radiated from antenna element 610. In an embodiment, RF reflectors 620 are supported by one or more supports (not shown) similar to RF reflector 412 described above with regard to FIG. 4. In an embodiment, RF reflectors 620 are electrically isolated from ground. The RF reflector support posts are omitted from FIG. 6 for clarity of the figure.

Antenna 600 may include additional components which are not shown in FIG. 6. For example, antenna 600 may include one or more feeders, described above, such as a cable or other type of transmission line, which connect a transmitter and/or receiver to one or more antenna elements 610. As another example, antenna 600 may include a base plate, to which support posts 612 may be attached, and a housing atop the base plate surrounding antenna elements 610. These additional components are omitted from FIG. 6 for clarity of the figure.

As depicted in FIG. 6, the configuration of three antenna elements 610 and their respective RF reflectors 620 divide the radiation pattern of antenna 600 into three sectors of approximately 120 degrees each. The term "sector" as used herein does not necessarily denote the functionality of sectors surrounding a typical macro cell, in which each cell sector utilizes its own set of one or more frequency channels. As used herein, the term "sectors" refers to separate areas, or directions, of coverage of a signal reflected by the respective individual RF reflectors 620. In an embodiment, a plurality or all of the antenna elements 610 transmit the same signal, the signal being reflected by each RF reflector 620 into a respective sector. As described above, in some embodiments antenna 600 includes fewer or more than three RF reflectors 620. The number of sectors depends on the number and configuration of individual RF reflectors 620. For example, four RF reflectors 620 positioned within and around the perimeter of a set of antenna elements 610 would divide the radiation pattern of antenna 600 into four sectors. In an embodiment, the angle of each RF reflector 620 is individually adjustable upward and/or downward, such that adjusting the angle of a given RF reflector changes the angle of the signal reflected from the given RF reflector 620 within the corresponding sector with respect to the plane of the set of antenna elements 610. Thus, in an embodiment, by separately adjusting the angles of the individual RF reflectors 620, the signal in one sector may be reflected, or deflected, sharply downward toward a target area near the small cell or antenna, while the signal in one or more other sectors may be directed at different angles toward target areas that are further from the small cell or antenna. In an embodiment, the same signal transmitted from the antenna elements 610 is reflected at a respective angle in each respective sector.

In an embodiment, reflector 620 includes an upper reflector portion 620A and a lower reflector portion 620B. In an embodiment, the angles of upper reflector portion 620A and lower reflector portion 620B are independently adjustable, such that the angle of a reflected signal is independently adjustable for each of upper reflector portion 620A and lower reflector portion 620B. For example, upper reflector portion 620A and lower reflector portion 620B may be connected via a hinge-type mechanism that allows each portion to move independently of the other portion. As another example, upper reflector portion 620A and lower reflector portion 620B may be separate components that are each individually connected to one or more support posts via pivot points, hinges, or other mechanisms.

Figure 7:
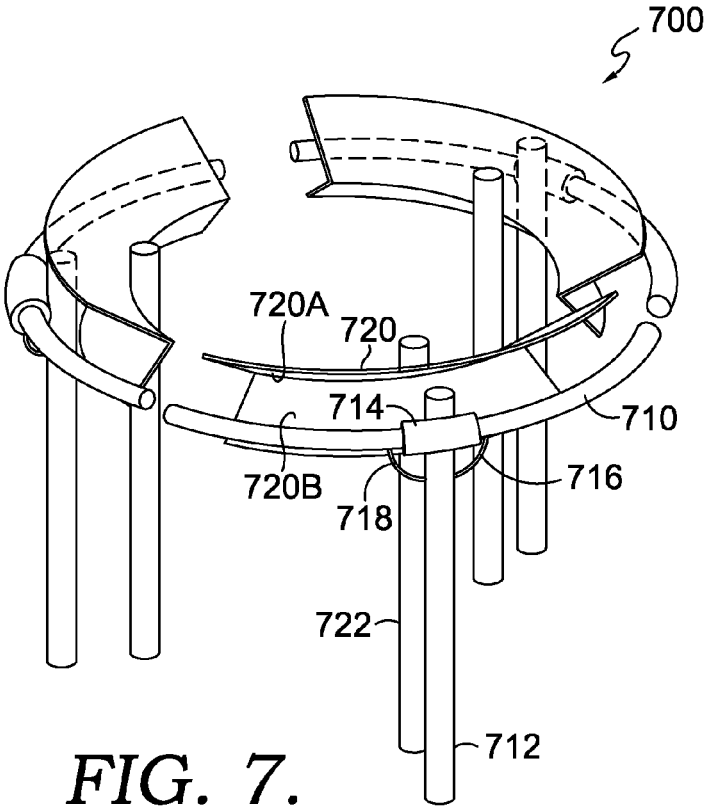
FIG. 7 depicts an antenna suitable for use with an embodiment of the invention.

With reference to FIG. 7, an antenna suitable for use with an embodiment of the invention is depicted, and is generally referred to as antenna 700. Antenna 700 is but one example of a suitable antenna, and is not intended to suggest any limitation as to the scope of use or functionality of embodiments of the invention. Neither should antenna 700 be interpreted as having any dependency or requirement relating to any single component or combination of components illustrated therein. Antenna 700 includes one or more antenna elements 710, support posts 712, fixtures 714, and conductors 716 and 718, which in an embodiment are similar to the corresponding parts of antenna 600 described above. Antenna 710 also includes one or more RF reflectors 720, which are affixed to one or more reflector support posts 722. RF reflector 720 may be similar to RF reflector 620 described above. In an embodiment, RF reflector 720 is curved such that it generally follows the shape or curvature of antenna element 710, as depicted in FIG. 7. In some embodiments, RF reflectors 720 may have other shapes as well. In an embodiment, the angle of RF reflector 720 is adjustable upward and/or downward, such that adjusting the angle of RF reflector 720 changes the angle of a reflected signal, similar to RF reflector 412 described above with regard to FIG. 4. The angle of RF reflector 720 may be adjusted manually at the time of installation, during a scheduled maintenance procedure, or at other times. In an embodiment, RF reflector 720 includes an upper reflector portion 720A and a lower reflector portion 720B. In an embodiment, the angles of upper reflector portion 720A and lower reflector portion 720B are independently adjustable, such that the angle of a reflected signal is independently adjustable for each of upper reflector portion 720A and lower reflector portion 720B, similarly to reflector 620 described above with regard to FIG. 6. Although FIG. 7 depicts three RF reflectors 720, in some embodiments antenna 700 includes fewer or greater than three RF reflectors 720. Antenna 700 may include additional components which are not shown in FIG. 7. For example, antenna 700 may include one or more feeders, such as a cable or other type of transmission line, which connect a transmitter and/or receiver to one or more antenna elements 710. As another example, antenna 700 may include a base plate and a housing atop the base plate surrounding antenna element 710. These additional components are omitted from FIG. 7 for clarity of the figure.

Figure 8:
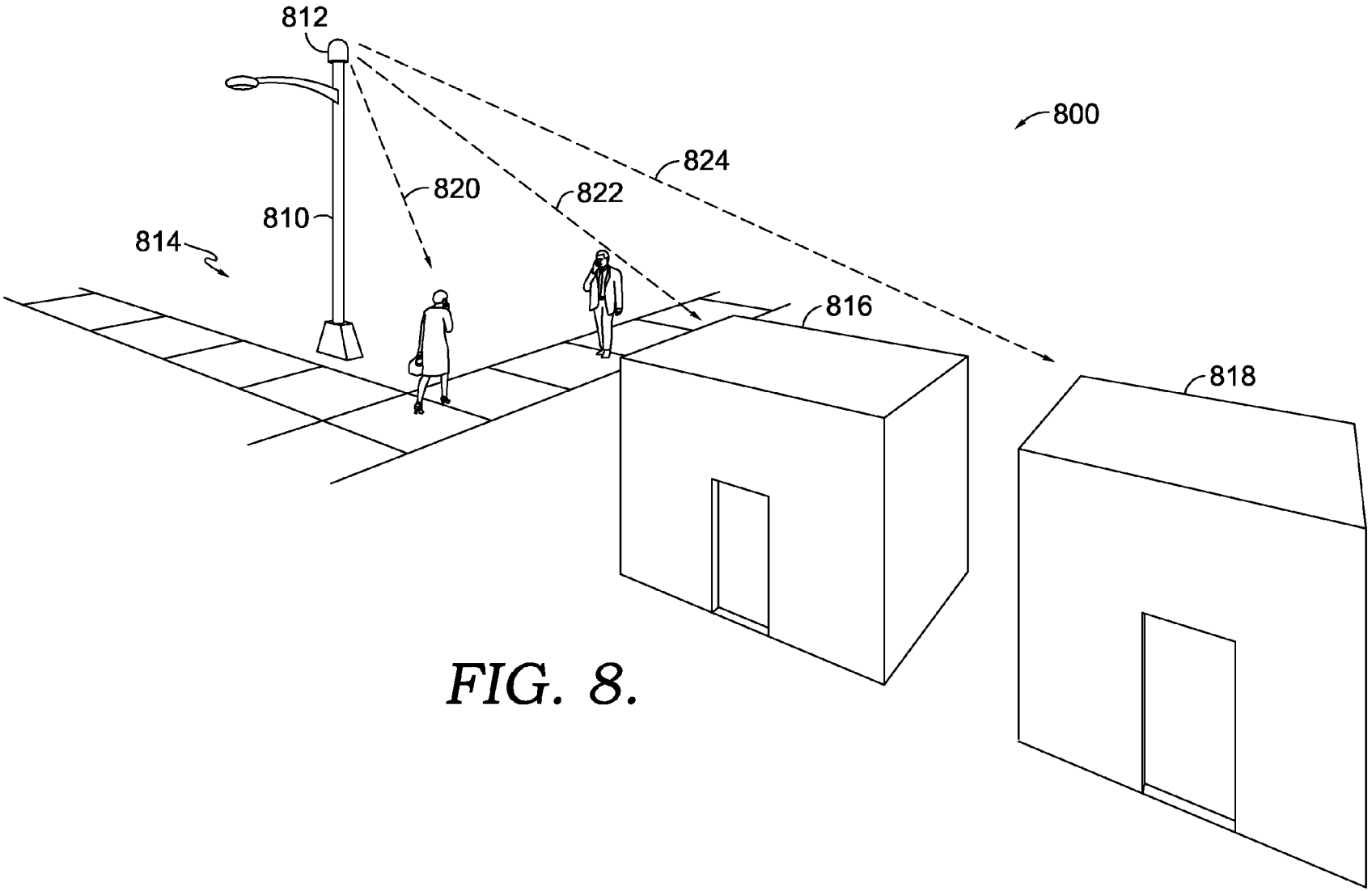
FIG. 8 depicts an environment suitable for use with an embodiment of the invention.

With reference to FIG. 8, an environment is depicted that is suitable for use with an embodiment of the present invention, and is generally referred to as environment 800. Environment 800 is but one example of a suitable environment, and is not intended to suggest any limitation as to the scope of use or functionality of embodiments of the invention. Neither should environment 800 be interpreted as having any dependency or requirement relating to any single component or combination of components illustrated therein. Environment 800 includes a light pole 810, a small cell 812, a pedestrian area 814, a building 816, a building 818, a reflected signal 820, a reflected signal 822, and a reflected signal 824. Small cell 812 is depicted as mounted on top of light pole 810, but in some embodiments may be mounted at some other height on light pole 810. In some embodiments, small cell 812 may be mounted on a flag pole, a utility pole, a building, or other types of poles, towers, or structures. Small cell 812 may also be located within a structure. Small cell 812 may utilize an antenna similar to any of antennas 200-700 described above. In an embodiment, small cell 812 utilizes an antenna having three sets of antenna elements, each set of antenna elements including three antenna elements, and a set of three antenna elements with RF reflectors positioned within each set of antenna elements, similar to RF reflectors 610 or RF reflectors 710 described above. Such a configuration would result in nine reflected signals, i.e., three reflected signals in each of three sectors. In another embodiment, small cell 812 utilizes an antenna having four sets of three antenna elements, similar to antennas 300 and 500 in FIGS. 3 and 5, respectively, and having a set of RF reflectors positioned within each set of antenna elements. Such an arrangement would provide four reflected signals in each sector, and a total of twelve reflected signals.

FIG. 8 depicts an embodiment of small cell 812 that utilizes an antenna having three sets of three antenna elements with a set of three RF reflectors positioned within each set of antenna elements. Although such an arrangement results in three reflected signals in each of three sectors, FIG. 8 only depicts three reflected signals within a single sector for the sake of clarity of the figure. As depicted, reflected signal 820 is directed downward toward pedestrian area 814, such that wireless network access, or cellular coverage, is provided to pedestrians' mobile devices, laptops, and so forth, within pedestrian area 814. In an embodiment, this is accomplished by having adjusted the angle of the corresponding bottommost RF reflector downward at the appropriate angle. The middle RF reflector may be adjusted at a shallower angle, such that reflected signal 822 is directed toward building 816, thereby providing wireless network access or cellular coverage to mobile devices, computers, and so forth within building 816. The uppermost RF reflector may be adjusted at a yet shallower angle, such that reflected signal 824 is directed toward building 818, thereby providing wireless network access or cellular coverage to mobile devices, computers, and so forth within building 818. However, the vertical position of an RF reflector with respect to the other RF reflectors does not require the RF reflector to be directed toward any particular area. For example, in an embodiment the bottommost RF reflector may be directed toward building 818, while the uppermost RF reflector may be directed toward pedestrian area 814.

Figure 9:
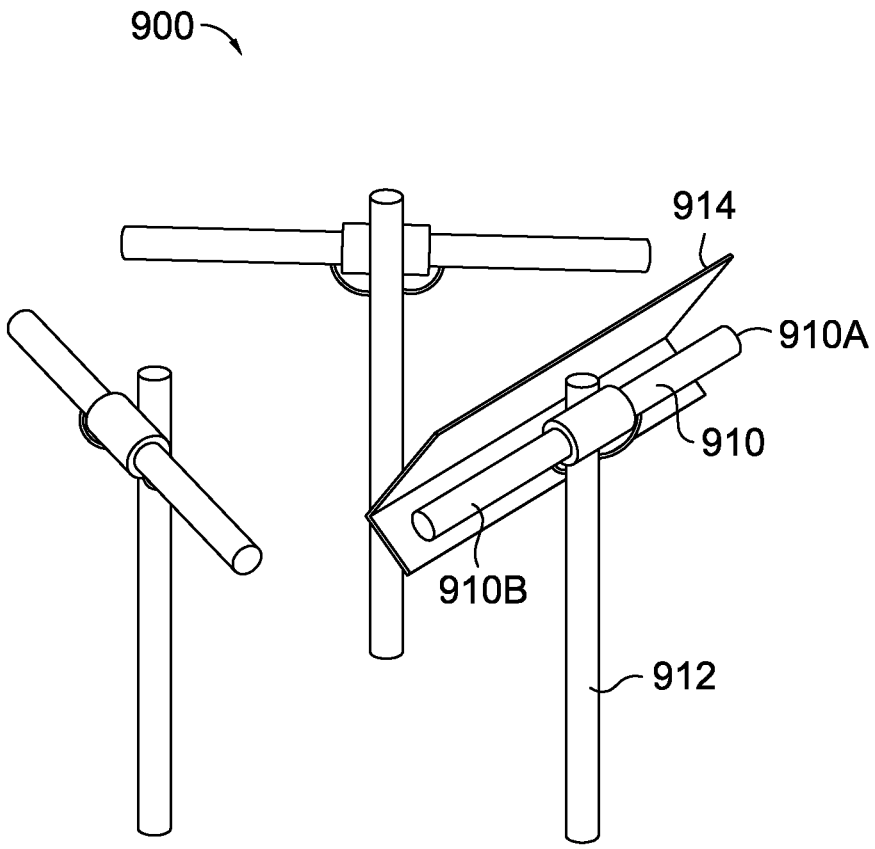
FIG. 9 depicts an antenna suitable for use with an embodiment of the invention.

With reference to FIG. 9, an antenna suitable for use with an embodiment of the invention is depicted, and is generally referred to as antenna 900. Antenna 900 is but one example of a suitable antenna, and is not intended to suggest any limitation as to the scope of use or functionality of embodiments of the invention. Neither should antenna 900 be interpreted as having any dependency or requirement relating to any single component or combination of components illustrated therein. FIG. 9 is described below with reference to FIGS. 2 and 4. Antenna 900 includes an antenna element 910 that may be similar to antenna element 210 described above with regard to FIG. 2. However, unlike antenna element 210 as depicted in FIG. 2, antenna element 910 as depicted is linear, i.e., straight, instead of curved. Antenna element 910 may be supported by one or more supports 912, in a manner similar to antenna element 210 described above with regard to FIG. 2. In an embodiment, antenna element 910 is a dipole antenna element having a pole 910A and a pole 910B. In an embodiment, antenna 900 includes a set of three dipole antenna elements 910 which are straight and positioned in a triangular configuration. In an embodiment, the configuration of antenna elements 910 is not limited to a triangular configuration, but may include other polygonal shapes as well as curved shapes, similar to antenna elements 210 described above.

Antenna 900 also includes an RF reflector 914 that is positioned proximate to antenna element 910, such that the reflective surface of RF reflector 914 reflects electromagnetic energy generated by antenna element 910 outward from antenna element 910 along, or at an angle to, the plane of the set of antenna elements 910. In an embodiment, RF reflector 914 is electrically isolated from ground. In an embodiment, RF reflector 914 is similar to RF reflector 412 described above with regard to FIG. 4. RF reflector 914 may be supported by one or more support posts (not shown). In an embodiment, the angle of RF reflector 914 is adjustable upward and/or downward, such that adjusting the angle of RF reflector 914 changes the angle of a reflected signal with respect to the plane of antenna elements 910. RF reflector 914 may be configured to be pivotable, similar to RF reflector 412 described above. Antenna 900 may include additional components which are not shown in FIG. 9. For example, antenna 900 may include one or more feed lines, such as a cable or other type of transmission line, which connects a transmitter and/or receiver to antenna element 910. As another example, antenna 900 may include a base plate, to which support post 912 is affixed, and a housing atop the base plate surrounding antenna element 910. These additional components are omitted from FIG. 9 for clarity of the figure.

Figure 10:
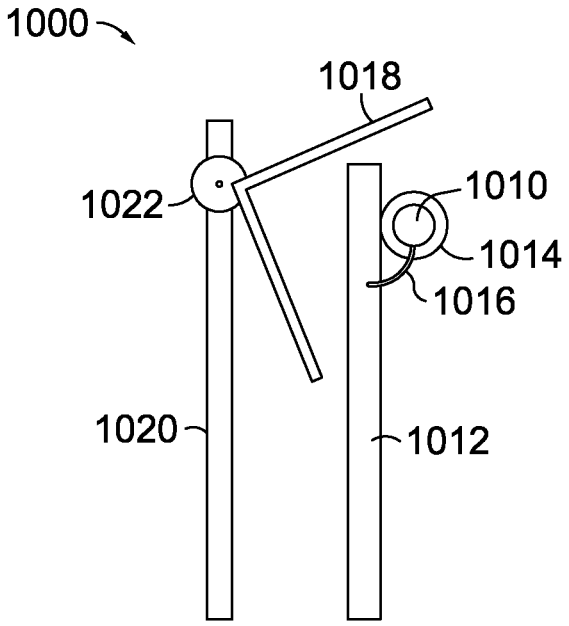
FIG. 10 depicts an edgewise view of an antenna portion suitable for use with an embodiment of the invention.

With reference to FIG. 10, an edgewise view of an antenna portion suitable for use with an embodiment of the invention is depicted, and is generally referred to as antenna portion 1000. Antenna portion 1000 is but one example of a suitable antenna portion, and is not intended to suggest any limitation as to the scope of use or functionality of embodiments of the invention. Neither should antenna portion 1000 be interpreted as having any dependency or requirement relating to any single component or combination of components illustrated therein. Antenna portion 1000 includes one or more antenna elements 1010, one or more support posts 1012, one or more fixtures 1014, one or more conductors 1016, one or more RF reflectors 1018, one or more support posts 1020, and one or more pivot points 1022. In an embodiment, one or more of antenna element 1010, support post 1012, fixture 1014, conductor 1016, RF reflector 1018, support post 1020, and pivot point 1022 are similar to their corresponding features described above with regard to FIGS. 2-9. As depicted in FIG. 10, RF reflector 1018 is positioned proximate to a portion of antenna element 1010, such that the reflective surface of RF reflector 1018 reflects electromagnetic energy generated by antenna element 1010 outward from antenna element 1010 at an angle determined by the angle of RF reflector 1018. Similarly to RF reflector 412 described above with regard to FIG. 4, the angle of RF reflector 1018 is adjustable upward and/or downward, such that adjusting the angle of RF reflector 1018 changes the angle, i.e., the direction, of the reflected signal.

Many different arrangements of the various components depicted, as well as components not shown, are possible without departing from the scope of the claims below. Embodiments of our technology have been described with the intent to be illustrative rather than restrictive. Alternative embodiments will become apparent readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. An antenna, comprising:

a set of antenna elements configured as a ring;

a plurality of radio-frequency (RF) reflectors positioned within and around the circumference of the ring and facing outward, wherein each RF reflector is configured to reflect an RF signal transmitted from the ring outwardly from the antenna at an angle with respect to the plane of the ring, wherein each RF reflector is individually adjustable, and wherein adjusting a respective RF reflector changes the respective angle of the reflected signal.

2. The antenna of claim 1, wherein each RF reflector is manually individually adjustable.

3. The antenna of claim 1, comprising:

one or more additional sets of antenna elements each configured as a ring;

for each additional set of antenna elements, a plurality of RF reflectors positioned within and around the circumference of the respective ring and facing outward, wherein each RF reflector is configured to reflect an RF signal transmitted from a respective antenna element outwardly from the antenna at an angle with respect to the plane of the respective ring.

4. The antenna of claim 3, wherein the set of antenna elements and the one or more additional sets of antenna elements are substantially parallel to each other and positioned substantially axially along a centerline perpendicular to the planes of the rings and passing through the center of each set of antenna elements.

5. The antenna of claim 3, wherein the set of antenna elements and the one or more additional sets of antenna elements are collectively driven by a single antenna feed.

6. An antenna, comprising:

a plurality of sets of antenna elements, wherein each set of antenna elements is configured as a ring oriented substantially horizontally, and wherein each set of antenna elements is positioned substantially vertically with respect to the other sets of antenna elements;

a set of radio-frequency (RF) reflectors positioned within each set of antenna elements, wherein each RF reflector is configured to reflect an RF signal transmitted from a respective antenna element outwardly from the antenna at an angle with respect to horizontal.

7. The antenna of claim 6, wherein each RF reflector is individually adjustable, and wherein adjusting a respective RF reflector changes the respective angle of the reflected signal.

8. The antenna of claim 7, wherein each RF reflector is manually individually adjustable.

9. The antenna of claim 6, wherein for each set of antenna elements, the RF reflectors within the respective set of RF reflectors are positioned end-to-end around the circumference of the set of antenna elements.

10. The antenna of claim 9, wherein for each set of RF reflectors, each RF reflector is positioned adjacent to a respective antenna element.

11. The antenna of claim 10, wherein for each antenna element, the respective RF reflector is configured to reflect an RF signal transmitted from the antenna element substantially outwardly from the antenna at a respective angle with respect to horizontal.

12. The antenna of claim 6, wherein the antenna elements are collectively driven by a single antenna feed.

13. A radio frequency (RF) reflector assembly, comprising:

a set of RF reflector segments positioned end-to-end in an approximation of a closed shape, wherein each RF reflector segment is configured to reflect outwardly from the closed shape, at an angle with respect to the plane of the closed shape, a signal generated proximate to the RF reflector segment, wherein each RF reflector segment is individually adjustable, and wherein adjusting a respective RF reflector segment changes the respective angle of the reflected signal.

14. The RF reflector assembly of claim 13, wherein each RF reflector segment is manually individually adjustable.

15. The RF reflector assembly of claim 13, wherein the RF reflector assembly is configured to be positioned within and around the circumference of a circular set of antenna elements such that each RF reflector segment is proximate to a respective antenna element, such that a signal generated by the respective antenna element is the signal generated proximate to the RF reflector segment.

16. The RF reflector assembly of claim 15, further comprising one or more additional sets of RF reflector segments, wherein for each additional set of RF reflector segments the RF reflector segments are positioned end-to-end in an approximation of the closed shape, the set of RF reflector segments and the one or more additional sets of RF reflector segments oriented substantially parallel to each other and positioned substantially axially along a centerline perpendicular to the planes of the closed shapes.

17. The RF reflector assembly of claim 16, wherein each set of RF reflector segments is configured to be positioned within and around the circumference of a respective set of antenna elements.

18. The RF reflector assembly of claim 17, wherein the respective sets of antenna elements are collectively driven by a single antenna feed.

* * * * *